US005305021A

United States Patent [19]

Ota et al.

[11] Patent Number: 5,305,021

[45] Date of Patent: Apr. 19, 1994

[54] THERMAL HEAD

[75] Inventors: Shigenori Ota; Kenji Nakai; Akihiro Kawata, all of Kagoshima, Japan

[73] Assignee: Kyocera Corporation, Kyoto, Japan

[21] Appl. No.: 44,548

[22] Filed: Apr. 7, 1993

Related U.S. Application Data

[63] Continuation of Ser. No. 738,224, Jul. 30, 1991, abandoned.

[30] Foreign Application Priority Data

Jul. 31, 1990 [JP] Japan ..... 2-204238

[51] Int. Cl.[5] ..... B41J 2/335

[52] U.S. Cl. ..... 346/76 PH; 400/82

[58] Field of Search ..... 346/76 PH; 400/82

[56] References Cited

U.S. PATENT DOCUMENTS

| | | | |
|---|---|---|---|
| 4,680,593 | 7/1987 | Takeno et al. | 346/76 PH |
| 5,028,935 | 7/1991 | Warmack et al. | 346/76 PH |
| 5,223,855 | 6/1993 | Ota et al. | 346/76 PH |
| 5,223,856 | 6/1993 | Kawata et al. | 346/76 PH |

FOREIGN PATENT DOCUMENTS

| | | |
|---|---|---|
| 51-35138 | 3/1976 | Japan . |
| 54-87748 | 6/1979 | Japan . |
| 60-48375 | 3/1985 | Japan . |
| 61-44892 | 3/1986 | Japan . |
| 61-140844 | 9/1986 | Japan . |
| 62-37737 | 9/1987 | Japan . |
| 63-221055 | 9/1988 | Japan . |
| 0290454 | 11/1989 | Japan . |
| 1-175828 | 12/1989 | Japan . |
| 2-212157 | 8/1990 | Japan . |

*Primary Examiner*—Benjamin R. Fuller
*Assistant Examiner*—Huan Tran
*Attorney, Agent, or Firm*—Spensley Horn Jubas & Lubitz

[57] ABSTRACT

A wide-spanning thermal head used in a printer comprises a plurality of radiator metal plates attached to a metal support plate and a plurality of head substrates formed from ceramics or the like, one each attached on top of each radiator plate. A construction in which the end faces of the head substrates are made to abut against each other requires highly precise work and involves technical difficulty. Any variation in the gap between the end faces will result in the occurrence of a white streak degrading the print quality. To avoid this, the invention provides a construction in which the radiator plates are attached to the support plate with a gap provided between the radiator plates in such a manner that the ends of the head substrate on each radiator plate protrude beyond the corresponding ends of the radiator plate by a protruding amount d. Accordingly, as the head substrates and the radiator plates are heated up with the use of the thermal head, the radiator plates having a greater thermal expansion coefficient expand to a greater degree than the head substrates do. The difference in thermal expansion is accommodated by the protruding amount d so that a predetermined close gap is provided between the end faces of the head substrates. This serves to prevent degradation of the print quality.

14 Claims, 9 Drawing Sheets

Prior Art
Fig. 1
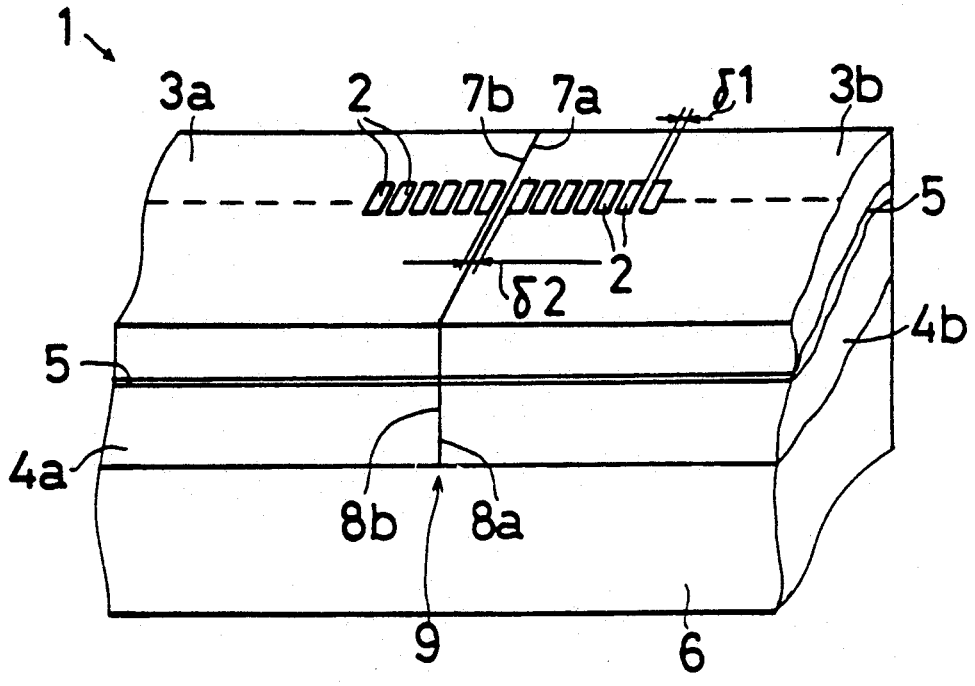
Prior Art
Fig. 2 (1)
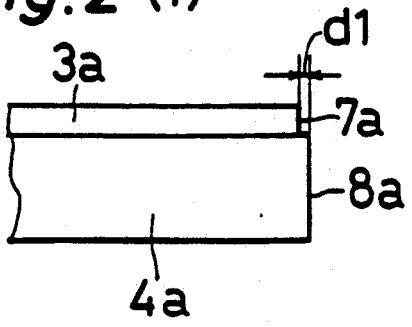
Prior Art
Fig. 2 (2)
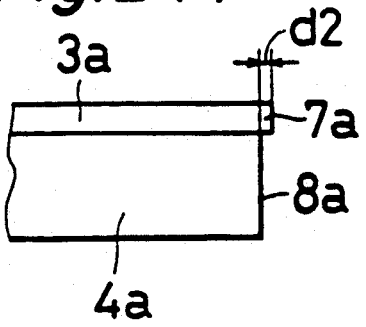

Prior Art Fig. 3 (1)
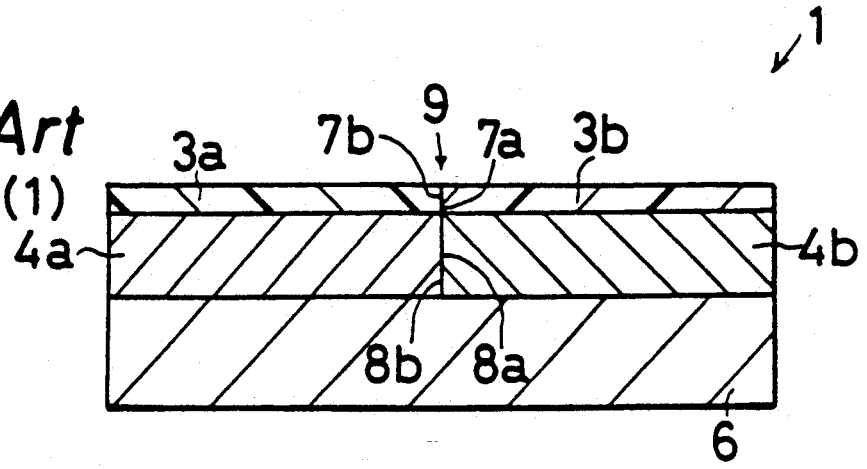
Prior Art Fig. 3 (2)
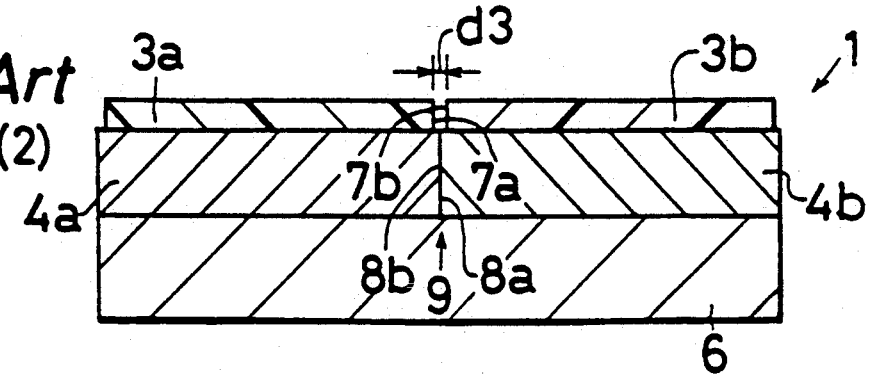
Prior Art Fig. 3 (3)
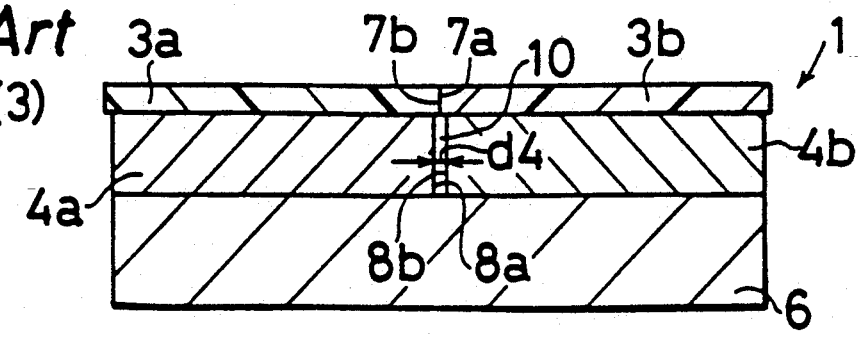

Fig. 8 (1)
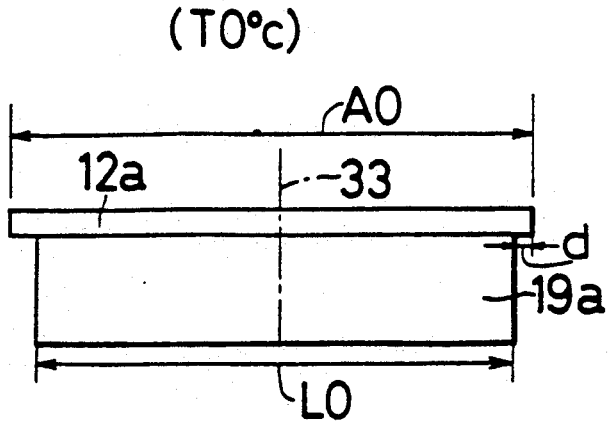
Fig. 8 (2)
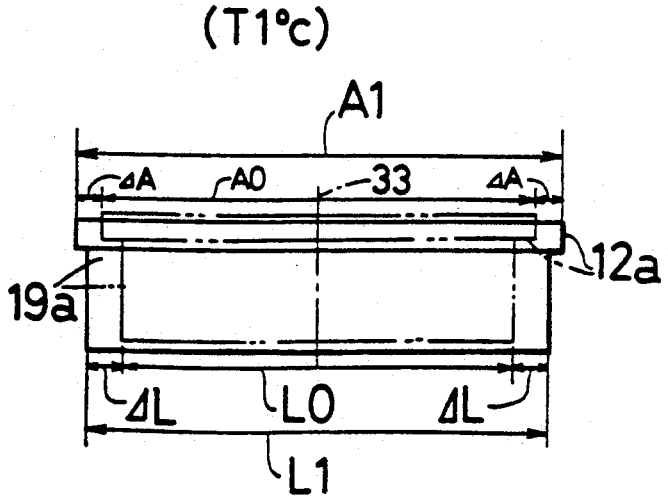

Fig. 11 (1)
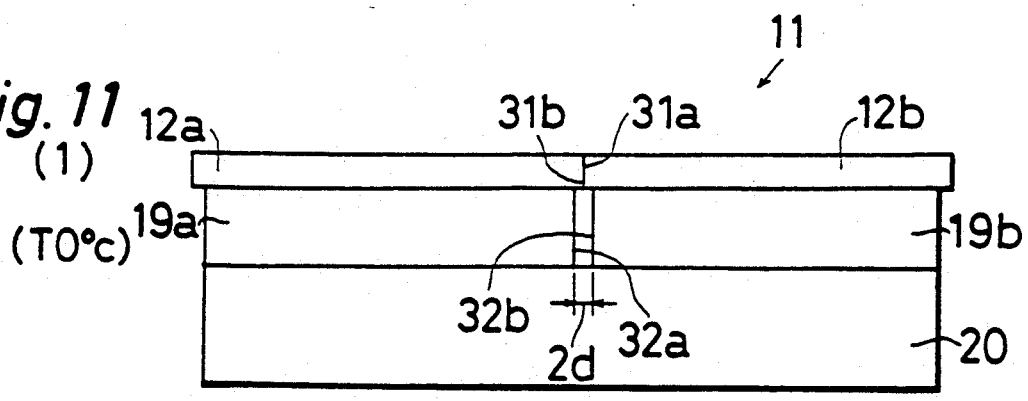
Fig. 11 (2)
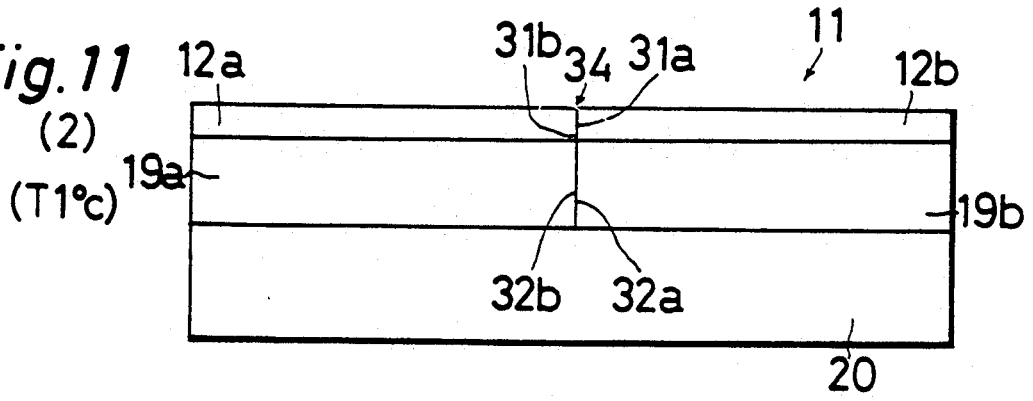
Fig. 11 (3)
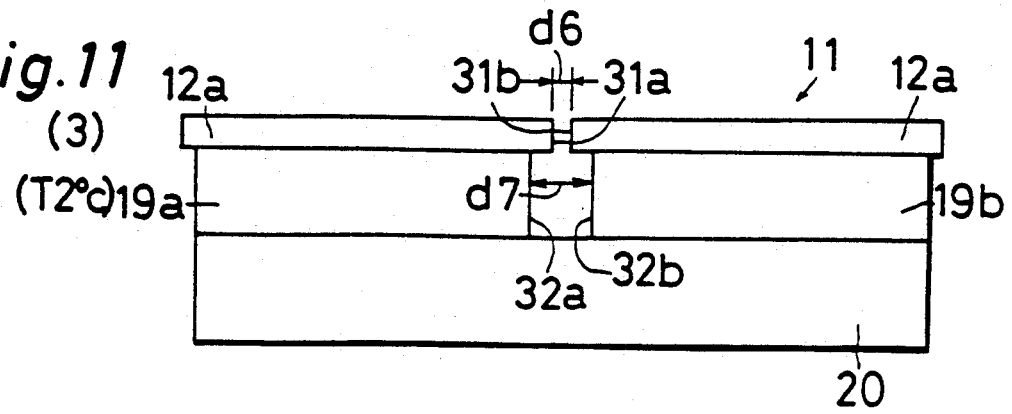

THERMAL HEAD

This is a continuation of application Ser. No. 07/738,224 filed on Jul. 30, 1991, now abandoned.

BACKGROUND OF THE INVENTION

1. Field of the Invention

The present invention relates to a thermal head, and more particularly to a wide-spanning thermal head constructed by combining a plurality of head substrates.

2. Description of the Prior Art

Thermal printers are used as printing devices for various information processing apparatus. In recent years, wide-spanning thermal heads have come to be employed for thermal printers to provide enlarged printing areas. When, for example, printing is to be made on a JIS (Japanese Industrial Standard) A2 size recording paper with its longer side as the printing direction, a wide-spanning thermal head is required which can provide a printing width of about 600 mm. However, it is difficult to arrange fine heating resistance elements in a straight line array along the length of about 600 mm on a single head substrate made for example of ceramics while maintaining uniform heating characteristics along the entire length. Therefore, a total printing width of 600 mm is usually realized, for example, by combining two head substrates each having numerous heating resistance elements arranged along its horizontal length of about 300 mm, the opposing ends thereof along the arranged direction being abutted against each other.

FIG. 1 is a perspective view showing the structure of a prior art thermal head 1 of such construction. The thermal head 1 comprises head substrates 3*a* and 3*b* which are made of ceramics such as aluminum oxide $Al_2O_3$ and each formed in a rectangular plate shape and on which numerous heating resistance elements 2 formed for example from tantalum nitride $Ta_2N$ or the like are arranged in a straight line array. Radiator plates 4*a* and 4*b* made of aluminum and formed in a rectangular plate shape are bonded to the head substrates 4*a* and 4*b*, respectively, using an elastic adhesive 5. This allows slight displacement of the head substrates 3*a* and 3*b* relative to the radiator plates 4*a* and 4*b*. The radiator plates 4*a* and 4*b* are fixed to a support plate 6 made of aluminum or other metallic material. The thus formed heating resistance elements 2 are selectively energized and heated to achieve printing by heating on a thermosensitive paper, for example.

The spacing δ1 between the heating resistance elements 2 on the head substrates 3*a* and 3*b* is, for example, 15 μm, with a pitch of 8 dots/mm. On the other hand, the spacing δ2 between the heating resistance elements 2 adjacent to each other across the junction between the two head substrates 3*a* and 3*b* needs to be set at less than twice the spacing δ1 in order to avoid the so-called blanking which results in the occurrence of a white streak where no image is produced when thermal printing is performed. Therefore, in the prior art construction, the distance from the heating resistance elements 2 adjacent to each other across the junction between the head substrates 3*a* and 3*b* to the respective ends of the head substrates 3*a* and 3*b* is appropriately determined so as to provide a prescribed spacing therebetween, while the head substrates 3*a* and 3*b* are secured to the radiator plates 4*a* and 4*b* in such a way that the opposing end faces 7*a* and 7*b* of the head substrates 3*a* and 3*b* become flush with the opposing end faces 8*a* and 8*b* of the radiator plates 4*a* and 4*b*, with the end faces 7*a* and 8*a* abutting against the end faces 7*b* and 8*b* respectively.

SUMMARY OF THE INVENTION

The above described thermal head 1 has the following problems.

(1) It is difficult, in reality, to make the end faces 7*a* and 7*b* flush with the end faces 8*a* and 8*b* in such a manner as described above. For example, when the head substrate 3*a* is bonded to the radiator plate 4*a*, care is taken to make the end face 7*a* flush with the end face 8*a*, but in reality, the end face 7*a* recedes from the end face 8*a* by a distance d1 as shown in FIG. 2(1), or protrudes by a distance d2 as shown in FIG. 2(2) because of positioning accuracy. When the end faces 7*a* and 7*b* are not flush with the corresponding end faces 8*a* and 8*b*, one receding from or protruding beyond the other, print quality problems will occur. That is, in the case of FIG. 2(1), a white streak (blanking) where printing is blanked appears on the thermosensitive recording paper. On the other hand, in the case of FIG. 2(2), if the protruding distance d2 of the head substrate 7*a* is excessive, sufficient heat dissipation cannot be achieved for the heating resistance element 2 disposed in the protruding portion, resulting in the production of a low contrast, low quality image.

(2) When securing the radiator plates 4*a* and 4*b*, with the head substrates 3*a* and 3*b* bonded thereon, to the support plate 6, fine metal particles coming off the radiator plates 4*a* and 4*b* and the support plate 6, as well as airborne dust, are likely to be trapped between the end faces 8*a* and 8*b* of the radiator plates 4*a* and 4*b* secured onto the support plate 6. It would require a lot of manhour and equipment to precisely control the distance between the end faces 8*a* and 8*b* to within 10 μm.

(3) As previously described, the end faces 8*a* and 8*b* of the radiator plates 4*a* and 4*b* are made to abut against each other. This requires that the end faces 8*a* and 8*b* be formed perpendicular to the arranged direction of the heating resistance elements 2, but to form the end faces 8*a* and 8*b* in such a precise manner would involve an increase in manhour. Also, fine burrs and other irregularities are likely to occur when forming the end faces 8*a* and 8*b*. To precisely finish the end faces 8*a* and 8*b* free from burrs and other irregularities would also involve an increase in manhour.

(4) The head substrates 3*a* and 3*b* are formed from ceramics such as alumina, while the radiator plates 4*a* and 4*b* and the support plate 6 are formed from aluminum. Their thermal expansion coefficients αA and αB are respectively expressed as:

$$\alpha A = 0.73 \times 10^{-5\circ}\ \text{C.}^{-1} \quad (1)$$

$$\alpha B = 2.4 \times 10^{-5\circ}\ \text{C.}^{-1} \quad (2)$$

Also, the construction is such that, under room temperature (e.g. 25° C.), the end faces 7*a* and 7*b* are flush with the corresponding end faces 8*a* and 8*b*, as shown in FIG. 3(1), at an abutting position 9 on the support plate 6 where the end faces abut against each other.

Here, it should be noted that the thermal expansion coefficient of the radiator plates 4*a* and 4*b* is greater than that of the heat substrates 3*a* and 3*b* and also that the end faces 8*a* and 8*b* of the radiator plates 4*a* and 4*b* abut against each other at the abutting position 9. Therefore, when the thermal head 1 is heated with use (for example, to 75° C.), the horizontal print centers of the radiator plates 4a and 4b become displaced toward opposite directions from each other. This causes the head substrates 3a and 3b to separate from each other, leaving a gap d3 (about 0.26 mm in the example shown) as shown in FIG. 3(2). When printing is made with such thermal head 1, a streak where printing is blanked appears, as previously described, causing a detrimental effect on the print quality. On the other hand, when the environment in which the thermal head 1 is used changes to lower temperatures (−25° C. for example), the radiator plates 4a and 4b contract to a greater degree than the head substrate 3a and 3b do, causing a gap 10 providing a separating distance d4 (about 0.26 mm) between the end faces 8a and 8b as shown in FIG. 3(3). In this case, sufficient heat dissipation cannot be achieved for the heat resistance elements 2 on the head substrates 3a and 3b positioned above the gap 10, resulting in unsatisfactory print quality as previously mentioned.

To solve such problems, a method may be considered in which the head substrates 3a and 3b and the radiator plates 4a and 4b are bonded together at the abutting position 9 using a hard adhesive, but this would require bonding work with the hard adhesive, resulting in an increase in manhour.

It is an object of the invention to provide a thermal head which overcomes the above technical problems, improves print quality, and permits reduction in manhour.

The thermal head of the present invention comprises: a plurality of head substrates each having numerous heating resistance elements arranged on one surface thereof, the head substrates being arrayed along the direction in which the heating resistance elements are arranged; a plurality of radiator members one each attached to the other surface of each head substrate and formed from a material having a greater thermal expansion coefficient than that of the head substrates; and a support member on which the radiator members are mounted in such a manner as to allow relative contact or apart between the head substrates and between the radiator members, wherein:

the spacing between the opposing end faces of the adjacent head substrates is smaller than the spacing between the opposing end faces of the radiator members attached thereto.

According to the invention, the thermal head includes a plurality of head substrates each having numerous heating resistance elements arranged on one principal surface thereof and a plurality of radiator members one each attached to the other surface of each head substrate and formed from a material having a greater thermal expansion coefficient than that of the head substrates. The head substrates and the radiator members are mounted on a support member in such a manner as to allow relative movement between the head substrates and between the radiator members, and the length along the arranged direction and the position of each head substrate and of each radiator member are determined so that the spacing between the opposing end faces of the adjacent head substrates is smaller than the spacing between the opposing end faces of the radiator members attached thereto. In other words, the head substrates are so mounted that, at the reference temperature, they protrude inwardly beyond the opposing end faces of the dissipating members.

As the thermal head is heated with use, the head substrates and the radiator members expand with heat, but the difference in thermal expansion between the head substrates and the radiator members is accommodated by the gap between the radiator members corresponding to the amount of protrusion of the head substrates, thereby preventing the head substrates from being separated from each other when heated, as is the case with the previously described prior art. On the other hand, when the operating environment is in a relatively low temperature, the radiator members contract to a greater degree than the head substrates. In the invention, by properly setting the amount of protrusion of the head substrates at the reference temperature, it is possible to prevent the gap between the radiator members from excessively widening when cooled. Accordingly, the invention prevents the occurrence of a streak where printing is blanked and the production of a low contrast image, which, as previously mentioned, have been the problems with the prior art. Thus, according to the invention, high quality printing operation is achieved.

Also, since the construction of the above thermal head is accomplished by properly determining the dimensions and relative positions of the head substrates and the radiator members, there is no need to provide additional processing steps for adhesives, etc. as in the prior art method, thus achieving reduction in manhour.

As described, according to the invention, the length along the arranged direction and the position of each head substrate and of each radiator member are determined so that the spacing between the opposing end faces of the adjacent head substrates is smaller than the spacing between the opposing end faces of the radiator members attached thereto. This prevents the head substrates from being separated from each other when heated, as is the case with the previously described prior art. On the other hand, when the operating environment is in a relatively low temperature, the radiator plates contract to a greater degree than the head substrates do. In the invention, by properly setting the amount of protrusion of the head substrates, it is possible to prevent the gap between the radiator members from excessively widening when cooled. Accordingly, the invention prevents the occurrence of a streak where printing is blanked and the production of a low contrast image, which, as described, have been the problems with the prior art.

Thus, according to the invention, high quality printing operation is achieved. Also, since the construction of the above thermal head is accomplished by properly determining the dimensions and relative positions of the head substrates and of the radiator members, there is no need to provide additional processing steps for adhesives, etc. as in the prior art method, thus achieving reduction in manhour.

BRIEF DESCRIPTION OF THE DRAWINGS

Other and further objects, features, and advantages of the invention will be more explicit from the following detailed description taken with reference to the drawings wherein:

FIG. 1 is a perspective view of a thermal head 1 of a typical prior art;

FIG. 2 is a front view showing the vicinity of an abutting position 9 on the thermal head 1;

FIG. 3 is a cross sectional view explaining prior art problems;

FIG. 8 is a diagram explaining the principle of this embodiment on which to determine a protruding amount d;

FIG. 11 is a diagram illustrating the conditions of the thermal head 11 at various temperatures.

DESCRIPTION OF THE PREFERRED EMBODIMENTS

Figure 4:
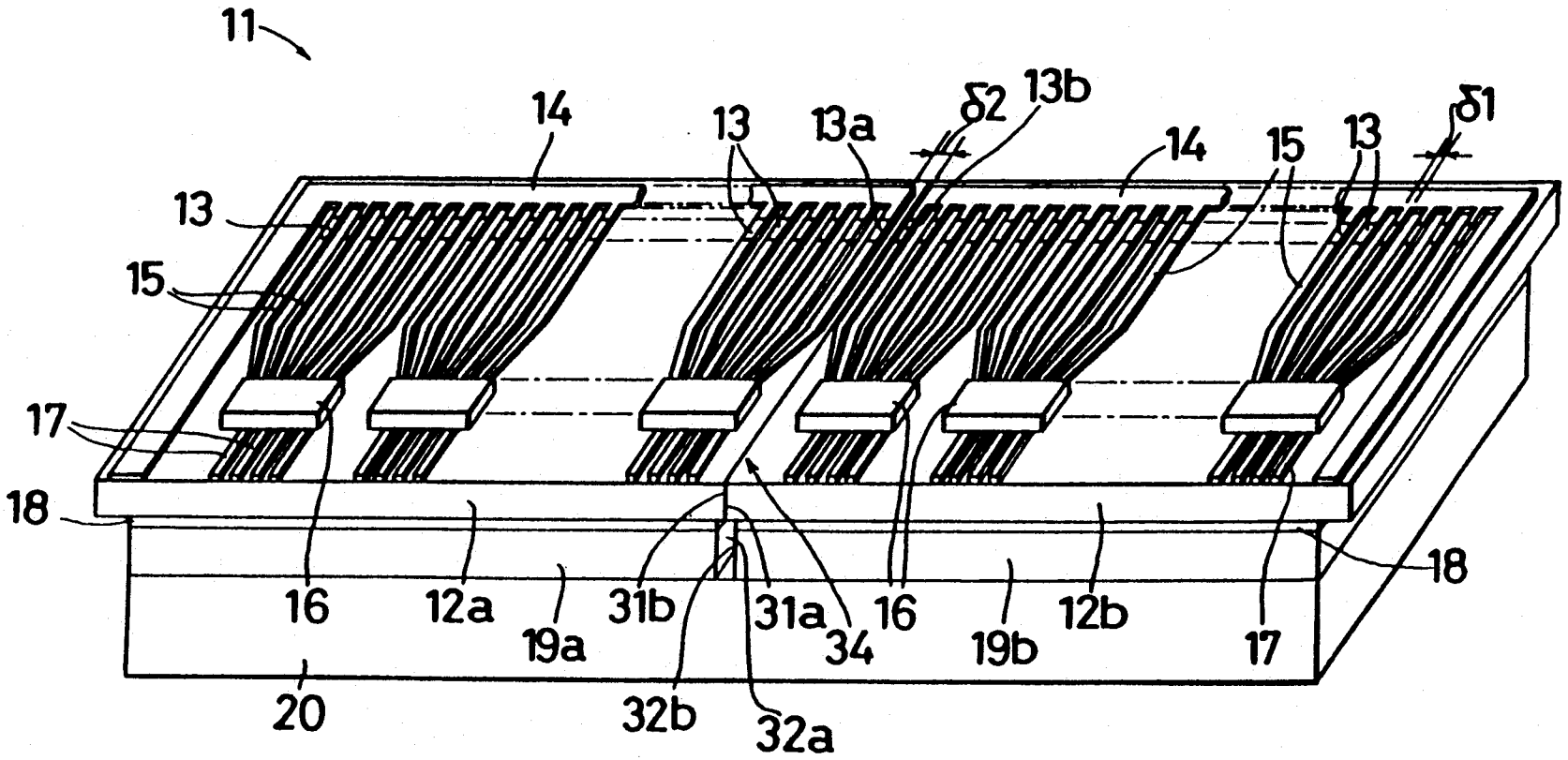
FIG. 4 is a perspective view of a thermal head 11 according to one embodiment of the invention.

Now referring to the drawings, preferred embodiments of the invention are described below.

Figure 5:
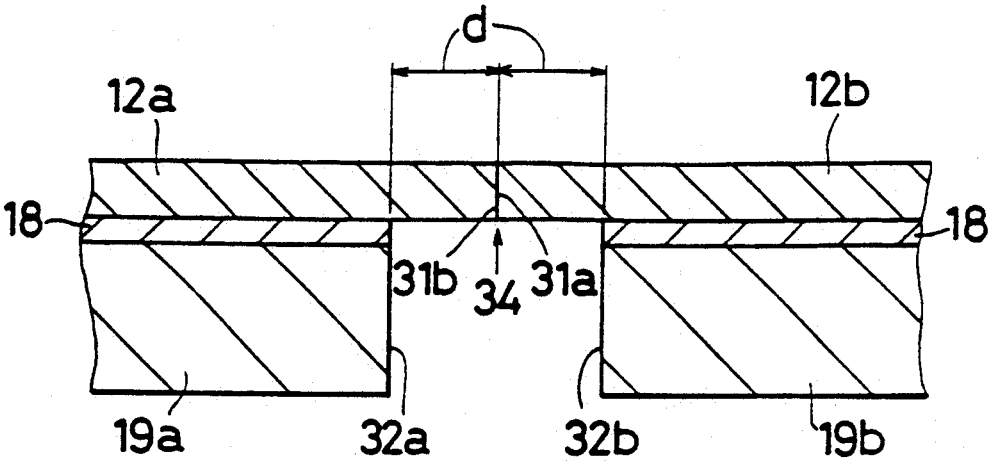
FIG. 5 is an enlarged cross sectional view showing the vicinity of an abutting position 34 on the thermal head 11.

FIG. 4 is a perspective view of a thermal head 11 in one embodiment of the invention, and FIG. 5 is a cross sectional view showing the vicinity of an abutting position 34 on the thermal head 11. The thermal head 11 comprises head substrates 12*a* and 12*b* each formed, for example, from aluminum oxide $Al_2O_3$ in a rectangular plate shape and having a thermal expansion coefficient $\alpha A = 0.73 \times 10^{-5}$° C.$^{-1}$. On the head substrates 12*a* and 12*b*, a plurality of heat resistance elements 13 formed, for example, from tantalum nitride $Ta_2N$, Nichrome Ni-Cr, ruthenium oxide $RuO_2$, or the like, are formed by thin-film techniques such as sputter deposition, thick-film techniques such as silk screen printing, or by etching, and are arranged in a straight line array in a density of 8 dots/mm with a spacing of δ1 (for example, 15 μm), each heating resistance element having a width W1 (for example, 110 μm) measured along the horizontal direction. The heating resistance elements 13 are heated, for example, to 400° C. when energized, to perform thermal printing on a thermosensitive recording paper or a thermosensitive film and recording paper.

The heating resistance elements 13 are connected in parallel to a common electrode 14 for each of the head substrates 12*a* and 12*b*, and an individual electrode 15 is connected to the side of each heating resistance element 13 opposite from the side thereof connected to the common electrode 14. A predetermined number of individual electrodes 15 are collectively connected to a driving circuit element 16 to which are connected a plurality of signal lines 17 for inputting image data and various control signals to the heating resistance elements 13 for printing. The common electrodes 14, the individual electrodes 15, and the signal lines 17 are formed from aluminum Al, gold Au, or other metal, using the above-mentioned thin-film techniques, thick-film techniques, or the like.

The thus constructed head substrates 12*a* and 12*b* are attached with an elastic adhesive 18 to radiator plates 19*a* and 19*b* formed, for example, from a metallic material such as aluminum having a thermal expansion coefficient $\alpha B = 2.4 \times 10^{-5}$° C.$^{-1}$, in such an arrangement as described hereinafter, and the radiator plates 19*a* and 19*b* are fixed onto a support plate 20 which is also formed from aluminum or other metallic material.

Figure 6:
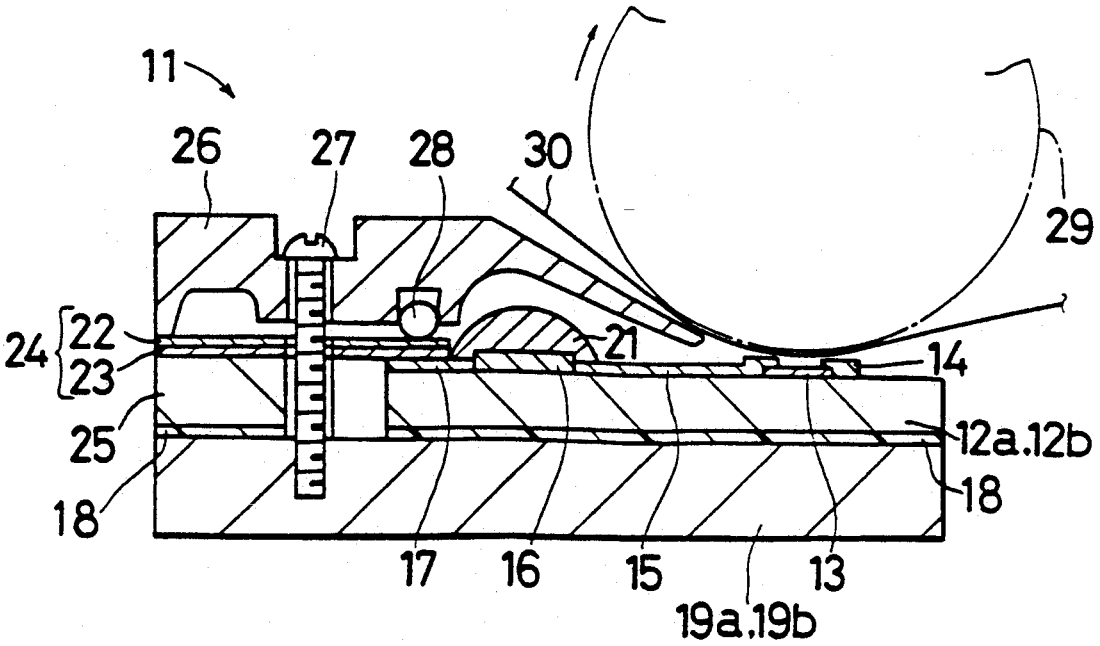
FIG. 6 is a cross sectional view showing the vicinity of the thermal head 11.

FIG. 6 is an overall cross sectional view of the thermal head 11. While the thermal head 11 is constructed as described above, each driving circuit element 16 is covered with a protective layer 21. The end portion of each signal line 17 opposite from the end thereof connected to the driving circuit element 16 is connected to a flexible wiring board 24 consisting of a circuit wiring pattern 23 formed on a flexible film 22. The flexible wiring board 24 is disposed above the radiator plates 19*a* and 19*b* via a spacer 25 attached thereto with the elastic adhesive 18. There is also provided a head cover 26 covering the area extending from the individual electrodes 15 to the flexible wiring board 24, the head cover 26 being fixed to the radiator plates 19*a* and 19*b* with screws 27. The head cover 26 contains an elastic piece 28 that serves to press the flexible wiring board 24 onto the signal lines 17 on the head substrates 12*a* and 12*b*.

The thus constructed thermal head 11 is disposed in close proximity to a platen roller 29, the heating resistance elements 13, pressing a thermosensitive recording paper 30 against the platen roller 29, being selectively energized and deenergized, to produce a desired image on the recording paper 30.

In this embodiment, based on the principle hereinafter described, the opposing end faces 31*a* and 31*b* of the head substrates 12*a* and 12*b* are disposed closer to each other than the opposing end faces 32*a* and 32*b* of the radiator plates 19*a* and 19*b* are. The resulting construction is such that the end faces 31*a* and 31*b* each protrude beyond the end faces 32*a* and 32*b* of the radiator plates 19*a* and 19*b* by a protruding length d, as shown in FIG. 2.

Figure 7:
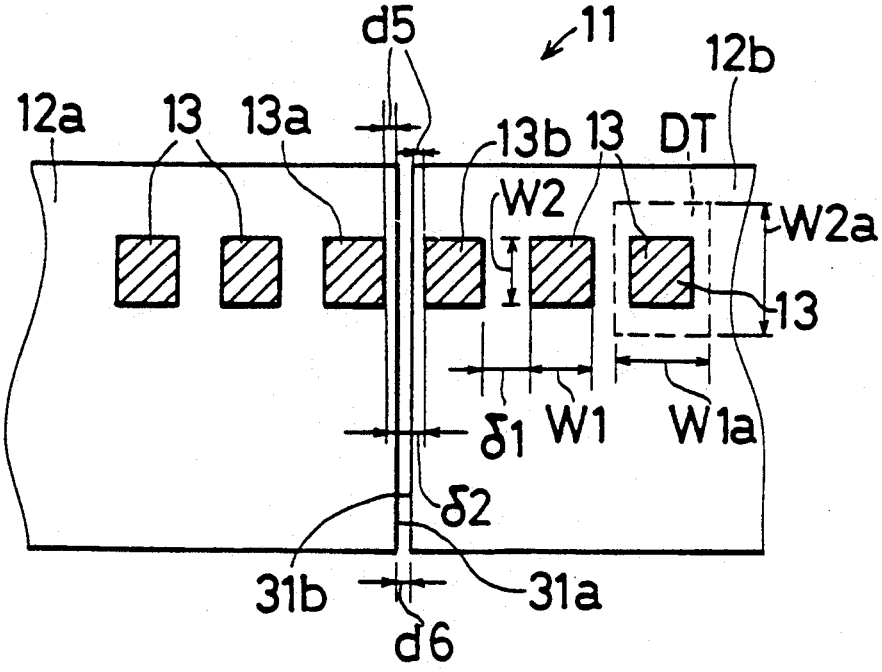
FIG. 7 is a top plan view of the thermal head 11.

The following describes the principle on which the protruding length d is determined. FIG. 7 shows a front view of the thermal head 11. The heating resistance elements 13 are arranged at intervals of δ1 on the head substrates 12*a* and 12*b*. It is therefore desirable that the spacing δ2 between the heating resistance elements 13*a* and 13*b* adjacent to each other across the junction between the head substrates 12*a* and 12*b* should be equal to the spacing δ1, and it is desirable that this relationship be maintained over the entire temperature range from the relatively low temperature environment to the heat-up temperature of the thermal head. In this embodiment, the construction is so adapted as to prevent the head substrates 12*a* and 12*b* from being separated from each other due to the thermal expansion of the radiator plates 19*a* and 19*b*, which has been the problem with the previously described prior art.

FIG. 8(1) shows the conditions of the radiator plate 19*a* and the head substrate 12*a* at room temperature T0° C. (for example, at 25° C.), the width of the head substrate 12*a* being denoted by A0 and the width of the radiator plate 19*a* by L0. FIG. 8(2) shows the conditions at temperature T1° C., the width A1 of the head substrate 12*a* and the width L1 of the radiator plate 19*a* at this temperature having the following relationships:

$$A1 = A0 + 2\Delta A \quad (3)$$

$$L1 = L0 + 2\Delta L \quad (4)$$

while variations ΔA and ΔL due to the temperature change have a plus or a minus sign and are defined as follows:

$$\Delta A = A0(T1 - T0)\alpha A/2 \quad (5)$$

$$\Delta L = L0(T1 - T0)\alpha B/2 \quad (6)$$

This embodiment is so constructed that the following relationship holds for the widths A1 and L1 of the head substrate 12*a* and the radiator plate 19*a* at temperature T1.

$$A1/2 \geqq L1/2 \quad (7)$$

That is, the widthwise center of the head substrate 12*a* and the widthwise center of the radiator plate 19*a* are aligned with the center line 33, as shown in FIG. 8(1), the widthwise ends of the head substrate 12*a* protruding beyond the respective widthwise ends of the radiator plate 19*a* by a length d. Therefore, the relationship between the widths A0 and L0 is expressed as:

$$L0 = A0 - 2d \quad (8)$$

Here, the equations (3) to (6) and (8) are substituted in the equation (7) and rearranged to obtain the following result.

$$d \geqq A0(T1 - T0)(\alpha B - \alpha A)/2(1 + (T1 - T0)\alpha B\{ \quad (9)$$

Therefore, the lower limit value for the protruding length d is obtained by substituting the required width of the head substrate 12*a* for A0 and the lowest temperature within the applicable operating temperature range with respect to the reference temperature for T1.

In this embodiment, the allowable range of the length d is determined as shown below based on the above calculation and various experiments conducted by the present inventor.

$$0.15 \text{ mm} \leqq d \leqq 0.8 \text{ mm} \quad (10)$$

If the protruding length d is smaller than 0.15 mm, when the thermal head 11 is heated, the radiator plates 19*a* and 19*b* expand further after the opposing end faces 32*a* and 32*b* thereof have come into contact with each other, thus causing the head substrates 12*a* and 12*b* to be separated from each other. On the other hand, it has been found that the protruding length greater than 0.8 mm affects the heating resistance elements 13 positioned above the gap between the end faces 32*a* and 32*b* shown in FIG. 4. As the data shown in FIG. 9 indicates, the ratio of the size of the heating resistance element 13 to the size of the print dot DT becomes almost constant and saturated when the protruding length d is greater than 0.8 mm. As the protruding length d further increases, the breakdown power ratio shown in FIG. 10 decreases, shortening the life of the heating resistance elements 13 positioned in the protruding portions and also resulting in blurred printing as described in connection with the prior art.

Figure 9:
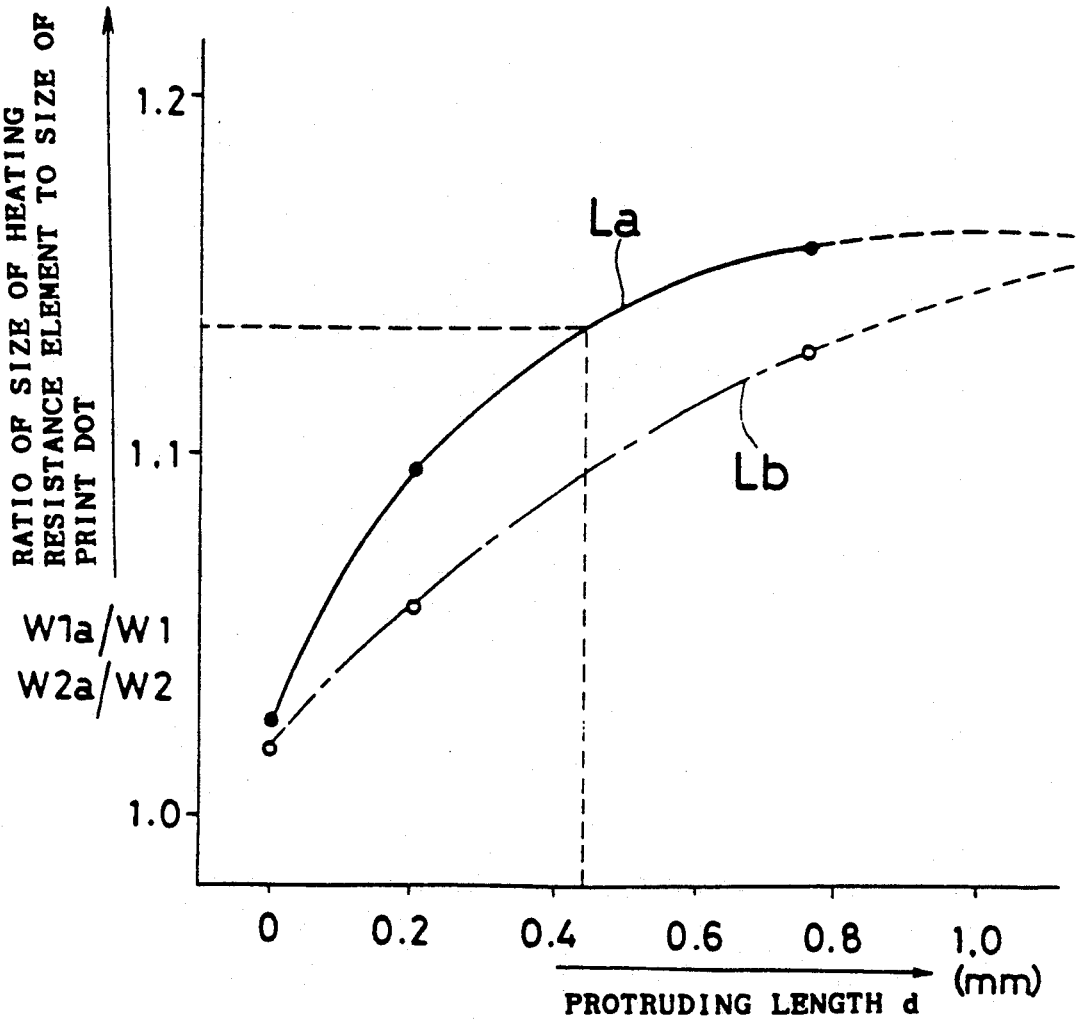
FIGS. 9 and 10 are graphs explaining the principle on which to determine the protruding amount d.

That is, when the horizontal and vertical lengths of the heating resistance element 13 are denoted as W1 and W2, as shown in FIG. 7, and the corresponding lengths of the print dot shown by dotted line in FIG. 7 as W1*a* and W2*a*, the ratios W1*a*/W1 and W2*a*/W2 increase as the protruding length d increases, as shown by lines La and Lb in the graph of FIG. 9, the line La representing the horizontal ratio W1*a*/W1 and the line Lb the vertical ratio W2*a*/W2.

Figure 10:
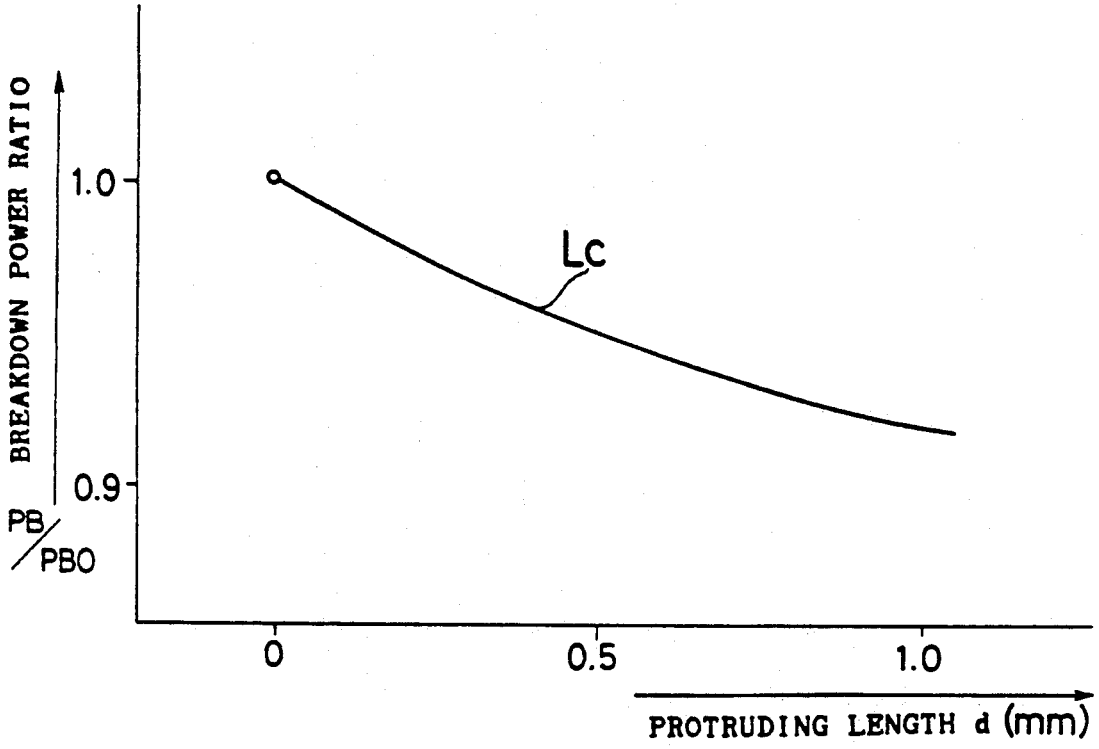

Also, as shown by line Lc in the graph of FIG. 10 which represents the ratio PB/PBO, i.e. the ratio of the breakdown power PB of the heating resistance elements 13*a* and 13*b* at the extreme ends of the radiator plates 19*a* and 19*b* to the breakdown power PBO of the other heating resistance elements 13 disposed thereon, the breakdown voltage decreases as the protruding length d increases, because of decreasing heat dissipation effect for the heating resistance elements 13 in the protruding portions. In consideration of these points, the upper limit value for the protruding length d is set at about 0.7 mm. If the protruding length d exceeds 0.7 mm, there arise not only the above problems but also the problem that the protruding end portions of the head substrates 12*a* and 12*b* warp toward the radiator plates 19*a* and 19*b*, resulting in uneven print density.

In the thermal head 11 in which the protruding length d is determined as described above, the radiator plates 19*a* and 19*b* are arranged with a gap 2*d* provided therebetween, as shown in FIG. 11(1), at room temperature T0° C. At this time, the opposing end faces 31*a* and 31*b* of the head substrates 12*a* and 12*b* are in contact with each other. When the temperature rises higher than the room temperature T0° C. (for example, to 75° C.), the head substrates 12*a* and 12*b* expand with heat and are displaced toward opposite directions from each other, as shown in FIG. 11(2), since the end faces 31*a* and 31*b* are in contact with each other at the abutting position 34.

In the meantime, the radiator plates 19*a* and 19*b* expand with heat, closing the gap 2*d* or causing the end faces 32*a* and 32*b* to come into contact with each other. However, since the protruding length d provided on each of the head substrates 12*a* and 12*b* serves to accommodate the thermal expansion of the radiator plates 19*a* and 19*b*, the end faces 31*a* and 31*b* of the head substrates 12*a* and 12*b* are prevented from being separated from each other, which has been the problem with the previously described prior art.

When the thermal head 11 is cooled to the applicable lowest temperature T2° C., the head substrates 12*a* and 12*b* and the radiator plates 19*a* and 19*b* contract, leaving a gap d6 between the end faces 31*a* and 31*b* and a gap d7 between the end faces 32*a* and 32*b*. The protruding length d is suitably determined so that the gaps d6 and d7 do not become excessive.

Referring back to FIG. 7, the spacing δ2 between the heating resistance elements 13*a* and 13*b* at the adjacent ends of the head substrates 12*a* and 12*b* is generally determined by the distance d5 between the heating resistance elements 13*a*, 13*b* and the end faces 31*a*, 31*b* of the head substrates 12*a*, 12*b* and by the gap d6 between the end faces 31*a* and 32*b*. In this embodiment, as described with reference to FIG. 11, the gap d6 is set at 0 over the temperature range from around the room temperature T0° C. to the high temperature T1° C. Therefore, the distance d5 is set as small as possible, for example, to about 5 to 10 μm, so that the spacing δ2 is approximately equal to the spacing δ1. This prevents a streak that blanks printing from appearing at a portion corresponding to the abutting position 34 when thermal printing is performed with the thermal head 11.

Figure 12:
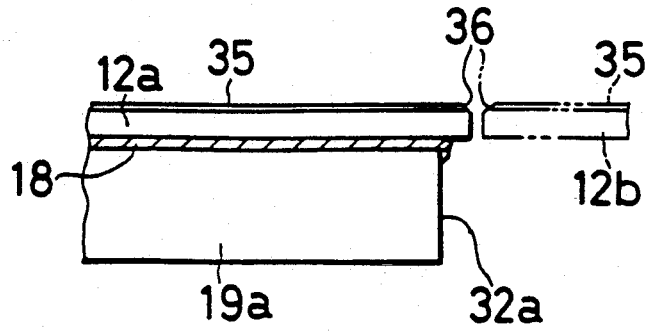
FIG. 12 is a cross sectional view of a portion of the thermal head 11.

FIG. 12 shows a front view of the head substrate 12*a* and the radiator plate 19*a*. In this embodiment, on the surface of the head substrate 12*a* opposite from the side thereof facing the radiator plate 19*a*, there is formed a passivation layer 35 formed, for example, from silicon nitride SiN or the like in the purpose of protecting heating resistance elements et al. on the head substrate 12*a* and 12*b*. The passivation layer 35 being chamfered together with the periphery of the head substrate 12*a* to form a sloping face 36. The sloping face 36 may be formed either in a planar shape or in a curved shape.

The formation of the sloping face 36 serves to prevent otherwise angular portions of the head substrates 12*a* and 12*b* from chipping when the head substrates 12*a* and 12*b* come into contact with each other.

With the thermal head 11 of the above embodiment, the occurrence of a streak where thermal printing is blanked and the insufficient heat dissipation leading to low contrast thermal recording are prevented over the entire applicable temperature range. Also, in this embodiment, since the radiator plates 19*a* and 19*b* are spaced apart from each other at all times, the end faces 32*a* and 32*b* can be formed with relatively low precision while the end faces 31*a* and 31*b* of the head substrates 12*a* and 12*b* are made to contact each other, as opposed to the prior art construction which requires for the end faces 31*a* and 31*b* to be flush with the end faces 32*a* and 32*b*. Furthermore, according to the invention, while the elastic adhesive 18 applied between the head substrate 12*a* and the radiator plate 19*a* slightly bulges out at the endface 32*a*, as shown in FIG. 12, the gap provided between the end faces 32*a* and 32*b* serves to accommodate the bulging adhesive, thereby avoiding the manufacturing error which would otherwise be caused by the building-out of the elastic adhesive 18.

The invention may be embodied in other specific form without departing from the spirit or essential characteristics thereof. The present embodiment is therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A thermal head comprising:

a plurality of head substrates, each of said head substrates having a thermal expansion coefficient and also having numerous heating resistance elements arranged on a top surface thereof and having an end face, said head substrates being arrayed along a direction in which said heating resistance elements are arranged with the end faces of adjacent head substrates opposing one another;

a plurality of radiator members, each of said radiator members having an end face and being attached to a bottom surface of each of said head substrates so that the end face of the associated head substrate protrudes from the end face of the attached radiator member by a predetermined amount, and each of said radiator members having a thermal expansion coefficient greater than that of each of said head substrates; and a support member for mounting thereon said radiator members in such a manner as to allow relative contact or separation between said head substrates and between said radiator members;

wherein said predetermined amount of protrusion is determined as a function of the thermal expansion coefficients of each of said head substrates and each of said radiator members and is determined in a manner that a spacing between opposing end faces of adjacent two of said head substrates is always smaller than a spacing between opposing end faces of adjacent two of said radiator members attached thereto.

2. A thermal head as set forth in claim 1, wherein a hard passivation layer to protect heating resistance elements is formed on said top surface of each of said head substrates, said passivation layer being chamfered together with a periphery of the associated head substrate to form a sloping face.

3. A thermal head as set forth in claim 1 further comprising an elastic adhesive layer, wherein said head substrates are attached to said radiator members by said elastic adhesive layer.

4. A thermal head as set forth in claim 1, wherein each of said head substrates and each of said radiator members respectively have a width A0 and a width L0 measured at room temperature T0 along said direction in which the heating resistance elements are arranged, and a width A1 and a width L1 measured at temperature T1 along said direction, said width A0 and said width L0 having relationships respectively with said width A1 and said width L1, with respect to width variations ΔA and ΔL resulting from a temperature change, the relationships being expressed as:

$$A1=A0+2\ \Delta A \quad (1)$$

$$L1+L0+2\ \Delta L \quad (2)$$

where the variations ΔA and ΔL are expressed as:

$$\Delta A=A0(T1-T0)\ \alpha A/2\ \alpha A\text{: Thermal expansion coefficient of head substrate} \quad (3)$$

$$\Delta L=L0(T1-T0)\ \alpha B/2\ \alpha B\text{: Thermal expansion coefficient of radiator member} \quad (4)$$

while an amount of protrusion d by which the head substrate protrudes beyond the radiator member and which is expressed as:

$$L0=A0-2d \quad (5)$$

is determined in such a manner as to satisfy a range expressed by:

$$d \geqq A0(T1-T0)\ (\alpha B-\alpha A)/2\{1+(T1-T0)\alpha B\} \quad (6).$$

5. A thermal head as set forth in claim 4, wherein an amount of protrusion d is in a range expressed by:

$$0.15\ \text{mm} \leqq d \leqq 0.8\ \text{mm} \quad (7).$$

6. A thermal head as set forth in claim 4, wherein said head substrates are made from aluminum oxide having a thermal expansion coefficient of about $0.75\times10^{-5}$° C.$^{-1}$, and said radiator members are made from aluminum having a thermal expansion coefficient of about $2.4\times10^{-5}$° C.$^{-1}$.

7. A thermal head as set forth in claim 3, wherein said spacing between the opposing end faces of adjacent two of said head substrates is zero in a temperature range between about room temperature and about an operating temperature.

8. A thermal head as set forth in claim 7, wherein said room temperature is 25° C. and said operating temperature is 75° C.

9. A thermal head comprising:

a support member;

a plurality of radiator members provided on said support member with a first gap between adjacent two of said radiator members;

a plurality of head substrates, each of said head substrates including at least one heating resistance element and being coupled to a radiator member with a second gap between at least adjacent two of said head substrates; and thermal expansion compensating means for elastically maintaining said second gap to be zero in a temperature range between about room temperature and about an operating temperature.

10. A thermal head as set forth in claim 9, wherein said thermal expansion compensating means includes an elastic adhesive layer provided at least between each of said radiator members and each of said head substrates for absorbing thermal expansion of said radiator members when said head substrates abut against each other.

11. A thermal head as set forth in claim 9, wherein each of said plurality of radiator members has a first thermal expansion coefficient, and each of said plurality of head substrates has a second thermal expansion coefficient smaller than the first thermal expansion coefficient.

12. A thermal head as set forth in claim 9, wherein said room temperature is 25° C. and said operating temperature is 75° C.

13. A thermal head as set forth in claim 9, wherein a protective film layer is formed on said head substrates and on said at least one heating resistance element of each of said head substrates, said protective film being chamfered together with a periphery of the associated head substrate to form a sloping face.

14. A thermal head as set forth in claim 13 wherein said protective film layer comprises silicon nitride.

* * * * *